US011522316B2

(12) United States Patent
Sato et al.

(10) Patent No.: US 11,522,316 B2
(45) Date of Patent: Dec. 6, 2022

(54) CONNECTOR AND METHOD OF MANUFACTURING CONNECTOR

(71) Applicant: Molex, LLC, Lisle, IL (US)

(72) Inventors: Shuichi Sato, Yamato (JP); Koji Murakami, Yamato (JP); Mikiji Tanaka, Yamato (JP); Naoya Inoue, Yamato (JP)

(73) Assignee: Molex, LLC, Lisle, IL (US)

( * ) Notice: Subject to any disclaimer, the term of this patent is extended or adjusted under 35 U.S.C. 154(b) by 76 days.

(21) Appl. No.: 17/156,656

(22) Filed: Jan. 25, 2021

(65) Prior Publication Data

US 2021/0234303 A1 Jul. 29, 2021

(30) Foreign Application Priority Data

Jan. 27, 2020 (JP) ..... JP2020-010569
Nov. 9, 2020 (JP) ..... JP2020-186380

(51) Int. Cl.
*H01R 13/629* (2006.01)
*H01R 13/05* (2006.01)
*H01B 7/04* (2006.01)
*H01R 13/42* (2006.01)

(52) U.S. Cl.
CPC ..... *H01R 13/629* (2013.01); *H01B 7/04* (2013.01); *H01R 13/05* (2013.01); *H01R 13/42* (2013.01)

(58) Field of Classification Search
CPC ..... H01R 13/629; H01R 13/05; H01R 13/42; H01R 13/502; H01R 43/20; H01R 13/04; H01R 13/10; H01B 7/04
See application file for complete search history.

(56) References Cited

U.S. PATENT DOCUMENTS

| | | | | | |
|---|---|---|---|---|---|
| 2,869,091 | A * | 1/1959 | Preston | B61G 5/10 | 439/503 |
| 3,842,219 | A * | 10/1974 | Anderson | H04Q 1/14 | 379/325 |
| 11,005,202 | B2 * | 5/2021 | Nogawa | H01R 12/58 | |
| 11,114,803 | B2 * | 9/2021 | Laurx | H01R 13/6471 | |
| 2013/0102181 | A1 * | 4/2013 | Aimoto | H01R 13/187 | 439/350 |
| 2020/0153137 | A1 * | 5/2020 | Nogawa | H01R 12/57 | |

FOREIGN PATENT DOCUMENTS

| | | | |
|---|---|---|---|
| CN | 1677767 | A | 10/2005 |
| CN | 103066462 | A | 4/2013 |
| JP | 2006164797 | A * | 6/2006 |
| JP | 2010123312 | A | 6/2010 |
| JP | 2017041347 | A | 2/2017 |
| WO | 2010090211 | A1 | 8/2010 |

* cited by examiner

*Primary Examiner* — Abdullah A Riyami
*Assistant Examiner* — Nader J Alhawamdeh

(57) ABSTRACT

A connector 10 includes: a first housing 11A, a first terminal 51A attached to the first housing 11A; a second housing 11B separate from the first housing 11A; a second terminal 51B attached to the second housing 11B; a flexible member 81 where the first terminal 51A and second terminal 51B are connected to two ends, and connecting the first housing 11A and second housing 11B; and an aligning member 41 having a flexible member insertion cavity 44 where the flexible member 81 is inserted, and that is movably arranged between the first housing 11A and second housing 11B in a condition where the flexible member 81 is inserted.

10 Claims, 22 Drawing Sheets

41
42
44

44
42
45
43
42
45
43

42
45
43
44

11B
11a
13
11c 11a
11b
11d 13
13
11c
11a
15
11b
11d 11a
11b
13
11d

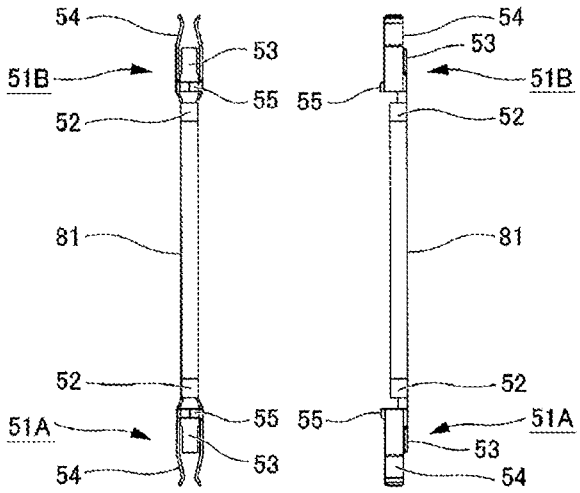
FIG. 6A FIG. 6B
FIG. 7
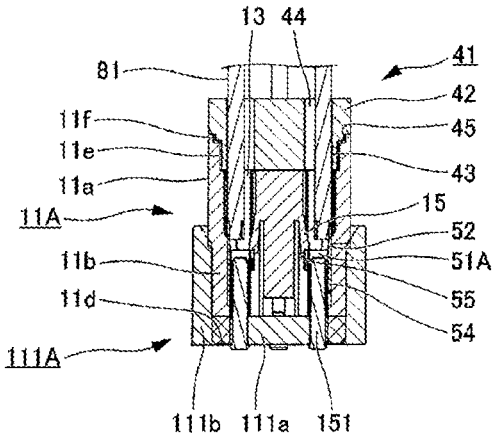

CONNECTOR AND METHOD OF MANUFACTURING CONNECTOR

RELATED APPLICATIONS

The present application claims priority to Japanese patent application no. 2020-010569 filed Jan. 27, 2020 and Japanese patent application no. 2020-186380 filed Nov. 9, 2020 which are incorporated by reference in their entireties.

TECHNICAL FIELD

The present disclosure relates to a connector and a method of manufacturing the connector.

BACKGROUND

Conventionally, various connectors are known for electrically connecting various substrates with various components that are driven in electrical apparatuses, electronic apparatuses, and the like.

For example, Patent Document 1 discloses a connector containing a housing, a terminal crimped onto a tip end of an electrical wire, and a retainer that connects the terminal to the housing, wherein (A) retainer locking means that lock the retainer to the housing 1 and (B) terminal locking means that lock the terminal to the retainer are (C) connected to the housing and terminal via the retainer, for the purpose of devising a connector configuration, such that a die-cutting space inside the housing is eliminated to improve waterproof properties and dustproof properties, the connector can be reduced in size without forming a lance part on the housing or terminal, and the terminal can be connected to the housing regardless of the orientation in a circumferential direction of the terminal.

Prior Art Documents; Patent Documents; Patent Document 1 JP 2010-123312 A

SUMMARY

However, with the connector disclosed in Patent Document 1, the terminal provided on one end of a flexible electrical wire is inserted into a housing, and the other end of the wire is a multi-core round cable. Therefore, when the connector disclosed in Patent Document 1 is used in a so-called connector with a relay wire provided with terminals and a housing on two ends of an electrical wire, a retainer and housing are required at each end part, and the configurations of (A), (B), and (C) and respective locking and connecting operations are required at each end.

In view of the foregoing, an object of the present disclosure is to provide: a connector where terminals positioned at two ends of a flexible member such as an electrical wire or the like can be accurately and easily inserted into a housing in a short amount of time; and a method of manufacturing the connector.

The present disclosure was proposed to achieve the aforementioned object. A first aspect of the present disclosure is a connector including: a first housing; a first terminal attached to the first housing; a second housing separate from the first housing; a second terminal attached to the second housing; a flexible member where the first terminal and the second terminal are connected at two ends, and connecting the first housing and the second housing; and an aligning member having a flexible member insertion cavity where the flexible member is inserted, and that is movably provided between the first housing and the second housing in a condition where the flexible member is inserted.

Furthermore, a second aspect of the present disclosure is a method of manufacturing a connector including a first housing, a first terminal attached to the first housing, a second housing separate from the first housing, a second terminal attached to the second housing, a flexible member where the first terminal and the second terminal are connected at two ends, and connecting the first housing and the second housing, and an aligning member having a flexible member insertion cavity where the flexible member is inserted, and that is movably provided between the first housing and the second housing in a condition where the flexible member is inserted. The method includes: a step of preparing a deflection member where the first terminal and second terminal are connected at two ends; a step of overlaying the first housing and the aligning member; a step of attaching the first terminal to the first housing by inserting the aligning member; a step of moving the aligning member in a direction of the second terminal in a condition where the flexible member is inserted in the aligning member; a step of inserting the second terminal into the aligning member to cause a contact piece on a tip end side thereof to protrude from the aligning member; and a step of storing the contact piece of the second terminal protruding from the aligning member in the second housing, and storing the second terminal in the second housing.

With the present disclosure, it is possible to provide: a connector where terminals positioned at two ends of a flexible member such as an electrical wire can be accurately and easily inserted into a housing in a short amount of time; as well as a method of manufacturing the connector.

BRIEF DESCRIPTION OF THE DRAWINGS

FIG. 3A is a top surface view, FIG. 3B is a side surface view, FIG. 3C is a bottom surface view, and FIG. 3D is a cross-sectional view.

FIG. 4A is a top surface view, FIG. 4B is a side surface view, FIG. 4C is a bottom surface view, and FIG. 4D is a cross-sectional view.

FIG. 5A is a top surface view, FIG. 5B is a side surface view, FIG. 5C is a bottom surface view, and FIG. 5D is a cross-sectional view.

FIGS. 6A and 6B are two-sided views of a flexible member according to Embodiment 1, where FIG. 6A is a first side surface view, and FIG. 6B is a second side surface view as viewed from a direction intersecting with FIG. 6A.

FIG. 7 is a cross-sectional view illustrating a condition where the first mating connector is connected to the first housing of the connector according to Embodiment 1.

FIG. 18A is a top surface view, FIG. 18B is a bottom surface view, FIG. 18C is a side surface view, and FIG. 18D is a cross-sectional view along arrows A-A in FIG. 18A.

FIG. 19A is a top surface view, FIG. 19B is a bottom surface view, FIG. 19C is a side surface view, and FIG. 19D is a cross-sectional view along arrows B-B in FIG. 19A.

FIG. 20A is a first side surface view, FIG. 20B is a second side surface view as viewed from a direction intersecting with FIG. 20A, and FIG. 20C is a third side surface view as viewed from a direction opposite from FIG. 20A.

FIG. 25A is a top surface view and FIG. 25B is a cross-sectional view along arrows C-C in FIG. 25A.

DETAILED DESCRIPTION OF THE PREFERRED EMBODIMENTS

Figure 1:
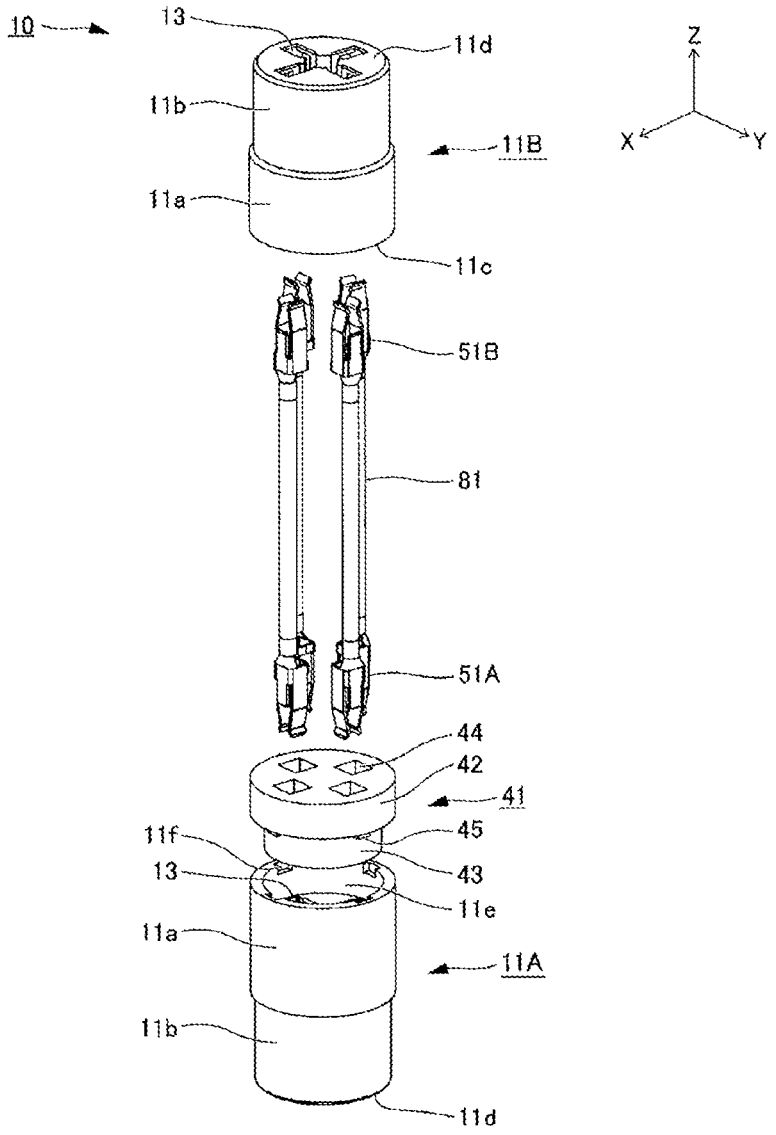
FIG. 1 is a perspective view prior to assembling a connector according to Embodiment 1.

Embodiment 1 according to the present disclosure will be described below in detail while referring to the drawings. Note that throughout the description of the embodiments, the same elements will be described with the same reference symbols. Note that expressions indicating directions such as "up", "down", "left", "right", "front", "back", and the like used to describe an operation or the configuration of parts of the connector 10 and other members in the description are relative directions and appropriate with the orientation illustrated in the drawings. However, if the orientation illustrated in the drawings changes, these directions should be interpreted differently based on the changes in orientation.

A connector 10 according to the present embodiment is a relay connector for electrically connecting a substrate (not illustrated in the drawings) to a mating member (not illustrated in the drawings) opposing the substrate. Furthermore, the connector is suitably used as a type of so-called floating connector having flexibility to provide a certain width to the positional relationship between the two parts. Various types of substrates can be used as the substrate, such as a printed circuit board, a flexible flat cable (FFC), a flexible printed circuit (FPC), and the like used for electrical equipment, electronic equipment, and the like.

As illustrated in FIG. 1, which is an exploded view prior to assembly, the connector 10 includes: a lower first housing 11A, a first terminal 51A attached to the first housing 11A; an upper second housing 11B separate from the first housing 11A; a second terminal 51B attached to the second housing 11B; a flexible member 81 where the first terminal 51A and second terminal 51B are connected to two ends, and connecting the first housing 11A and second housing 11B; and an aligning member 41 having a flexible member insertion cavity 44 where the flexible member 81 is inserted, and that is movably arranged between the first housing 11A and second housing 11B in a condition where the flexible member 81 is inserted. The first housing 11A and second housing 11B have a partially common structure and may be described as a housing 11 when both are collectively described in the present disclosure.

The arrangement relationship between the first housing 11A and second housing 11B is not particularly limited. Hereinafter, the first housing 11A is described as a side connected to a substrate, and the second housing 11B is described as a side connected to an electrical apparatus or the like. The housing 11 may be integrally formed by an insulating material such as a synthetic resin or the like.

The flexible member 81 may be concentrically arranged in a plurality of rows on an inner side and outer side. Herein, as illustrated in FIG. 1, a case where four flexible members 81 are arranged in a single circle is described. The flexible member 81 may be any type of member so long as the member is a long and narrow member having conductivity and flexibility, such as an electrical wire, for example. Furthermore, the flexible member 81 preferably has a hardness and length sufficient to be self-supporting when suitably used as a type of so-called floating connector. Herein, the member is described as being a relatively short and self-supporting rod-shaped member extending in a vertical direction molded by pressing a conductive metal plate.

The first terminal 51A formed from a conductive metal is connected to a lower end of the flexible member 81, and a second terminal 51B formed from a conductive metal is connected to an upper end. The first terminal 51A and second terminal 51B essentially have the same structure and may be described as a terminal 51 when both are collectively described in the present disclosure.

Returning to the housing 11, the first housing 11A and second housing 11B are, in common, members having an essentially cylindrical shape, and include a base end part 11*a* positioned on a side of the flexible member 81, and a tip end part 11*b* having a smaller outer diameter than the base end part 11*a* and positioned on an opposite side from the flexible member 81. Terminal storing cavities 13, which are through holes penetrating in the vertical direction, are formed in the housing 11. The entire first terminal 51A and a vicinity of a lower end of the flexible member 81 are stored in the terminal storing cavity 13 of the first housing 11A, and the entire second terminal 51B and a vicinity of an upper end of the flexible member 81 are stored in the terminal storing cavity 13 of the second housing 11B. Note that the shape of the housing 11 is not particularly limited to an essentially cylindrical shape, and may be, for example, a quadrilateral column with rounded corners.

The second housing 11B has a base end surface 11*c* of the base end part 11*a* positioned on the flexible member 81 side, and a tip end surface 11*d* of the tip end part 11*b* positioned on the opposite side from the flexible member 81. On the other hand, while the first housing 11A is similar to the second housing 11B in that the tip end part 11*b* has a tip end surface 11*d*, an aligning member storing recess part 11*e* for storing the aligning member 41 is provided on the flexible member 81 side of the base end part 11*a*. The first housing 11A differs from the second housing 11B on this perspective. Furthermore, a recess part 11*f* for positioning when storing the aligning member 41 is provided in the aligning member storing recess part 11*e*.

The aligning member 41 is a member for aligning the flexible member 81 and aligning the position and orientation thereof in order to store and attach the terminal 51 in the housing 11 when assembling the connector 10. The aligning member 41 includes a main body part 42 provided on the flexible member 81 side, in other words, the second housing 11B side, and a protruding part 43 having a smaller outer diameter than the main body part 42 and positioned on the opposite side from the flexible member 81, in other words, the first housing 11A side. The flexible member insertion cavity 44, which is a through hole penetrating the main body part 42 and protruding part 43 in the vertical direction, is formed in the aligning member 41. The main body part 42 of the aligning member 41 has essentially the same outer diameter as the base end part 11*a* of the housing 11. The protruding part 43 also has an outer diameter that allows storing in the aligning member storing recess part 11*e* of the first housing 11A. Note that in the present disclosure, the aligning member 41 is illustrated as having a substantially cylindrical shape in a two-stage configuration, but is not particularly limited to a substantially cylindrical shape. If the shape of the housing 11 is, for example, a rounded quadrilateral column shape of a two-stage configuration may be used to match the shape of the housing 11.

The aligning member 41 has a protrusion part 45 for positioning that protrudes downwardly, in other words, to the first housing 11A side, at a boundary between the main body part 42 and protruding part 43. The protrusion part 45 for positioning engages with the recess part 11*f* for positioning when the protruding part 43 is stored in the aligning member storing recess part 11*e* of the first housing 11A, in order to position the aligning member 41 and consequently the flexible member 81 with regard to the first housing 11A.

Figure 2:
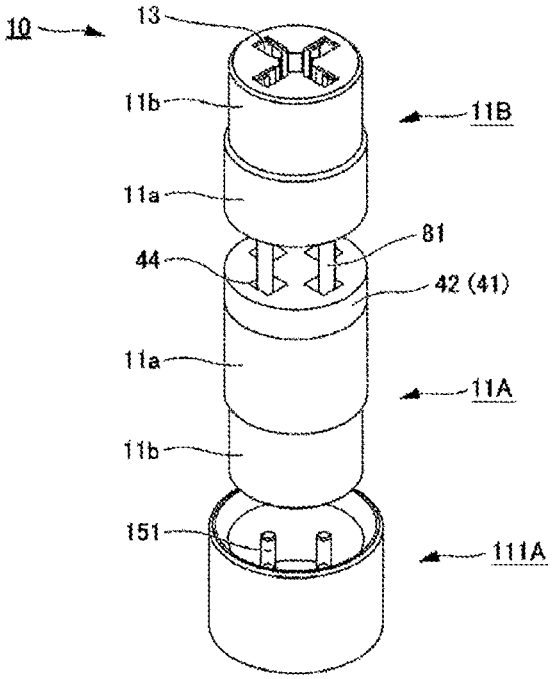
FIG. 2 is a perspective view after assembling the connector according to Embodiment 1, and is a perspective view including a first mating connector connected to a first housing thereof.

A condition after assembling the connector 10 is illustrated in FIG. 2. The assembled connector 10 is connected to a first mating housing 111A of a first mating connector provided on the substrate, and the first terminal 51A sandwiches a plug terminal 151 provided inside the first mating housing 111A to achieve an electrical connection. A condition where the first housing 11A and first mating housing 111A are connected will be described later with reference to FIG. 7. Although not illustrated in the drawings, the second terminal 51B is also connected in a similar manner to a second mating connector, and may be described as a mating housing 111 when both are collectively described in the present disclosure.

Each member configuring the connector 10 will be separately described. First, the aligning member 41 has an aspect illustrated in the top surface view of FIG. 3A, the side surface view of FIG. 3B, the bottom surface view of FIG. 3C, and the cross-sectional view of FIG. 3D. As described above, the aligning member 41 includes the main body part 42 positioned on the second housing 11B side and having a relatively large outer diameter, and the protruding part 43 positioned on the first housing 11A side, having a relatively small outer diameter, and stored in the aligning member storing recess part 11*e* of the first housing 11A. The aligning member 41 is maintained as a portion of the connector 10 after assembling the connector 10. Therefore, the main body part 42 not stored in the aligning member storing recess part 11*e* preferably has essentially the same outer diameter as the base end part 11*a* of the housing 11 so as to not interfere with mounting to an electrical apparatus or the like.

Figures 3A, 3B, 3C, 3D:
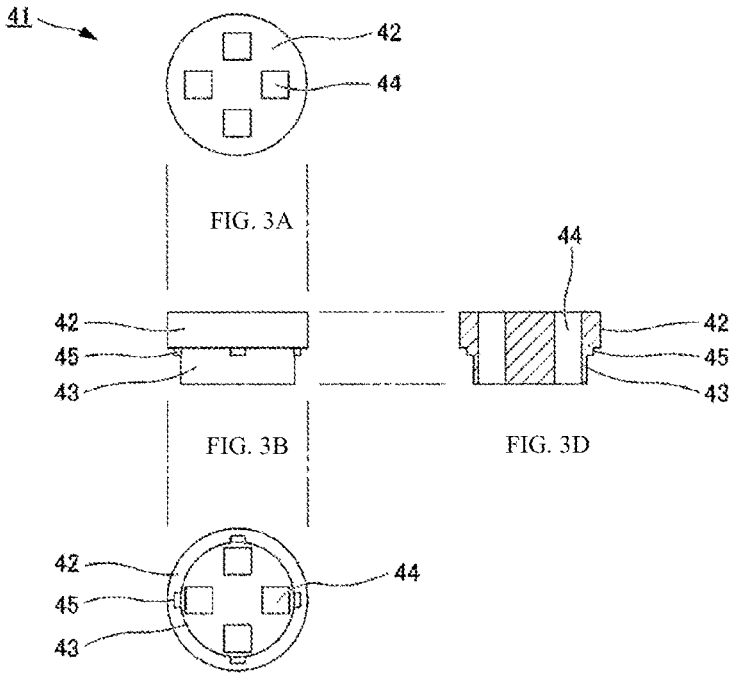
FIGS. 3A-3D are four-sided views of an aligning member according to Embodiment 1, where

The flexible member insertion cavity 44 provided in the aligning member 41 illustrated in FIG. 3D is an opening through which the first terminal 51A and second terminal 51B can be inserted and where the first terminal 51A and second terminal 51B are arranged to be attachable to the first housing 11A and second housing 11B. The shape of an opening of the flexible member insertion cavity 44 is formed as a quadrilateral shape (with rounded corners) to match the shape of the terminal 51, such that the terminal 51 can freely pass through the flexible member insertion cavity 44 but not significantly rotate about an inserting direction (for example, the vertical direction in FIG. 2) when passed through, and that the position in a direction perpendicular to the inserting direction (for example, lateral direction in FIG. 2) is oriented such that the terminal 51 can be stored in the terminal storing cavity 13 of the housing 11. Furthermore, the position of the flexible member insertion cavity 44 is at a position corresponding to an arrangement of the terminal storing cavity 13 of the first housing 11A and the second housing 11B.

As a result, when the first terminal 51A is attached to the first housing 11A and the flexible member 81 is connected to the housing 11, the aligning member 41 and first housing 11A are aligned and overlaid such that the flexible member insertion cavity 44 and terminal storing cavity 13 can be connected, and the first terminal 51A can be inserted from an upper opening of the flexible member insertion cavity 44. Thereafter, the first terminal 51A can be further inserted through the flexible member insertion cavity 44, and stored in the terminal storing cavity 13 of the first housing 11A.

The protrusion part 45 for positioning that protrudes downwardly at the boundary between the main body part 42 and protruding part 43 of the aligning member 41 is provided so as to correspond to the recess part 11*f* for positioning provided on an outer edge of the aligning member storing recess part 11*e* of the first housing 11A. When the protrusion part 45 for positioning and the recess part 11*f* for positioning engage, the flexible member insertion cavity 44 and terminal storing cavity 13 align to connect. Thus, when assembling the connector 10, the corresponding first terminal 51A and the flexible member insertion cavity 44 and terminal storing cavity 13 can be appropriately positioned such that the flexible member 81 is prevented from twisting.

Figures 4A, 4B, 4C, 4D:
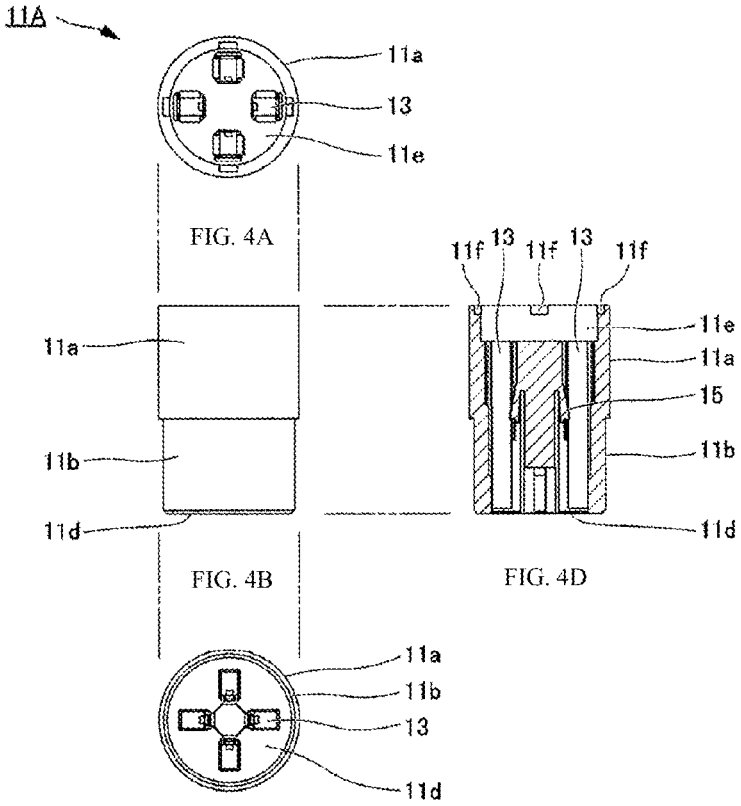
FIGS. 4A-4D are four-sided views of the first housing according to Embodiment 1, where

Next, the first housing 11A has a configuration illustrated in the top surface view of FIG. 4A, the side surface view of FIG. 4B, the bottom surface view of FIG. 4C, and the cross-sectional view of FIG. 4D. As described above, the first housing 11A includes the base end part 11*a* positioned on the flexible member 81 side and consequently the second housing 11B side and having a relatively large outer diameter, and the tip end part 11*b* positioned on the opposite side from the flexible member 81 and consequently the opposite side of the second housing 11B and having a relatively small outer diameter.

As illustrated in FIG. 4D, the aligning member storing recess part 11*e* that stores the protruding part 43 of the aligning member 41 is provided on the base end part 11*a* in the first housing 11A, unlike the second housing 11B. The recess part 11*f* for positioning is provided on the outer edge of the aligning member storing recess part 11*e* so as to correspond to the protrusion part 45 for positioning provided on the aligning member 41. Furthermore, the terminal storing cavity 13 is formed so as to penetrate from a bottom surface of the aligning member storing recess part 11*e* to the tip end surface 11*d*. The first terminal 51A is inserted into the terminal storing cavity 13 through the flexible member insertion cavity 44 from the bottom surface of the aligning member storing recess part 11*e*.

A lance 15 that engages with a locking piece 55 provided on the inserted first terminal 51A is formed on a wall surface on a central axis side of the first housing 11A in the terminal storing cavity 13 (refer to FIGS. 6A and 6B for the locking piece 55 and FIG. 7 for the engagement between the locking piece 55 and lance 15). The lance 15 is a cantilever-shaped member where a base end thereof is integrally connected to a wall surface of the terminal storing cavity 13 and a tip end thereof extends inward of the terminal storing cavity 13 and diagonally toward the tip end surface 11*d* as a free end. As a result, the first terminal 51A stored inside the terminal storing cavity 13 is prevented from moving to the aligning member storing recess part 11*e* side, and will not slip out even if the flexible member 81 is pulled to the second housing 11B side.

Figures 5A, 5B, 5C, 5D:
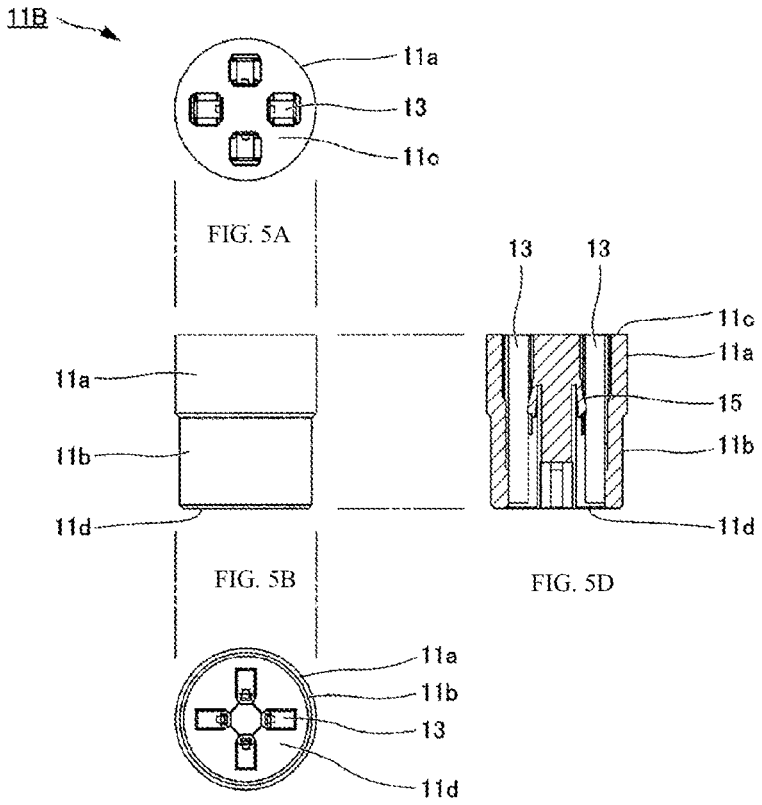
FIGS. 5A-5D are four-sided views of second housing according to Embodiment 1, where

Next, the second housing 11B includes an aspect illustrated in the top surface view of FIG. 5A, the side surface view of FIG. 5B, the bottom surface view of FIG. 5C, and the cross-sectional view of FIG. 5D. As described above, the second housing 11B includes the base end part 11*a* positioned on the flexible member 81 side and consequently the first housing 11A side and having a relatively large outer diameter, and the tip end part 11*b* positioned on the opposite side from the flexible member 81 and consequently the opposite side of the first housing 11A and having a relatively small outer diameter.

As illustrated in FIG. 5D, the aligning member storing recess part 11*e* is not provided in the second housing 11B, unlike the first housing 11A. Furthermore, the terminal storing cavity 13 is formed to penetrate from the base end surface 11*c* to the tip end surface 11*d*, and is formed such that the shape and arrangement of the opening thereof correspond to the aligning member 41 and first housing 11A. The second terminal 51B is inserted from the base end surface 11*c* into the terminal storing cavity 13.

Figure 15:
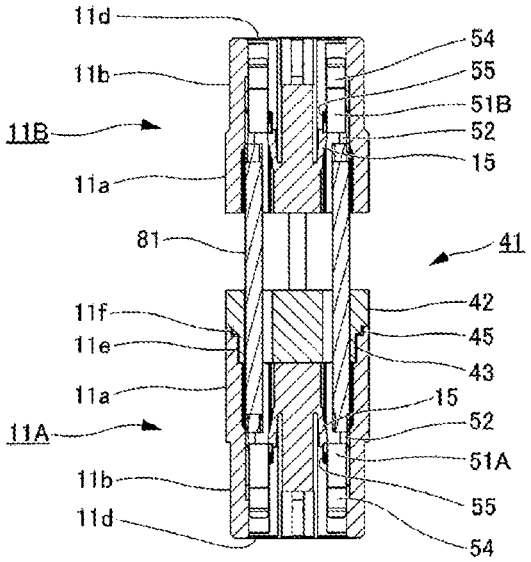
FIG. 15 is a cross-sectional view illustrating a condition of FIG. 14 where the aligning member separated from the second terminal of the flexible member is mounted on the first housing.

A lance 15 that engages with a locking piece 55 provided on the inserted second terminal 51B is formed on a wall surface on a central axis side of the second housing 11B in the terminal storing cavity 13 (refer to FIGS. 6A and 6B for the locking piece 55 and FIG. 15 for the engagement between the locking piece 55 and lance 15). The lance 15 is a cantilever-shaped member where a base end thereof is integrally connected to a wall surface of the terminal storing cavity 13 and a tip end thereof extends inward of the terminal storing cavity 13 and diagonally toward the tip end surface 11*d* as a free end. As a result, the second terminal 51B stored inside the terminal storing cavity 13 is prevented from moving to the base end surface 11*c* side, and will not slip out even if the flexible member 81 is pulled to the first housing 11A side.

Next, the flexible member 81 includes an aspect illustrated in the first side surface view of FIG. 6A and the second side surface view of FIG. 6B. The first terminal 51A and second terminal 51B provided on the two ends of the flexible member 81 include a base part 52 connected to an end part of the flexible member 81, a pair of contact pieces 54 extending from the base part 52 to a tip end, and a locking piece 55 protruding in a direction intersecting an axial direction of the flexible member 81 in the vicinity of a base end of the contact piece 54.

The pair of contact pieces 54 are bent to form a U shape from a bottom plate part 53 extending from the base part 52 to a tip end, and are bent such that a tip end side faces inward. The locking piece 55 is formed by forming a protrusion on an opposite side of the contact piece 54 from the bottom plate part 53, and bending the protrusion inward. The terminal 51 is formed by the pair of contact pieces 54, bottom plate part 53, and locking piece 55 to form a quadrilateral shape as viewed from the inserting direction of the flexible member 81. The first terminal 51A and second terminal 51B are attached to the flexible member 81 so as to face mutually opposite directions in the axial direction, but are in the same direction in a direction perpendicular to the axial direction.

The shape of the opening of the flexible member insertion cavity 44 is a quadrilateral shape that is slightly larger than the quadrilateral shape formed by the pair of contact pieces 54, bottom plate part 53, and locking piece 55 of the terminal 51. Thereby, the terminal 51 can be stored in the terminal storing cavity 13 through the flexible member insertion cavity 44, and alignment is possible without significant rotation about the inserting direction and without deviation of the position in the direction perpendicular to the inserting direction, such that attachment to the housing 11 is possible.

Herein, when the flexible member 81 is configured from an electrical wire, the base part 52 may be connected to an end part of the electrical wire by crimping. When the pair of contact pieces 54 are, for example, stored in the terminal storing cavity 13 of the first housing 11A from the aligning member storing recess part 11*e* side and attached to the first housing 11A, the contact pieces 54 sandwich the plug terminal 151 (refer to FIG. 2) of the first mating housing 111A inserted in the first housing 11A from the tip end surface 11*d* side. The same applies to the second housing 11B.

Based on the configuration of the members described above, FIG. 7 illustrates a condition where the first housing 11A and first mating housing 111A are connected, and the protruding part 43 of the aligning member 41 is stored in the aligning member storing recess part 11*e* of the first housing 11A. As illustrated in FIG. 7, the first terminal 51A passes through the flexible member insertion cavity 44 of the aligning member 41, and is secured by the locking piece 55 engaging with the lance 15 inside the terminal storing cavity 13 of the first housing 11A. Likewise, the tip end part 11*b* of the first housing 11A is mated inside the first mating housing 111A enclosed by a bottom plate 111*a* and side walls 111*b*, and the pair of contact pieces 54 of the first terminal 51A sandwich the plug terminal 151 of the first mating housing 111A.

In FIG. 7, the aligning member 41 is illustrated in a condition where the protrusion part 45 for positioning thereof engages with the recess part 11*f* for positioning of the aligning member storing recess part 11*e* of the first housing 11A, and the protruding part 43 is stored in the aligning member storing recess part 11*e*. This stored condition indicates a condition where the aligning member 41 is mounted on the aligning member storing recess part 11*e* or base end part 11*a* of the first housing 11A, and is movable along the flexible member 81 to the second housing 11B side (upper side in the drawings). Note that when preventing the aligning member 41 from freely moving to the flexible member 81 is desired after assembling the connector 10, the protrusion part 45 for positioning may be provided at a location deviating from the boundary between the base end part 11*a* and tip end part 11*b* to the tip end part 11*b* side, and the recess part 11*f* for positioning may be formed into an L shape as viewed from a side surface. Therefore, the aligning member 41 may be used as a simple locking mechanism within a range that does not hinder twisting of the flexible member 81.

Next, an assembly procedure of the connector 10 will be described with reference to FIGS. 8 to 15.

Figure 8:
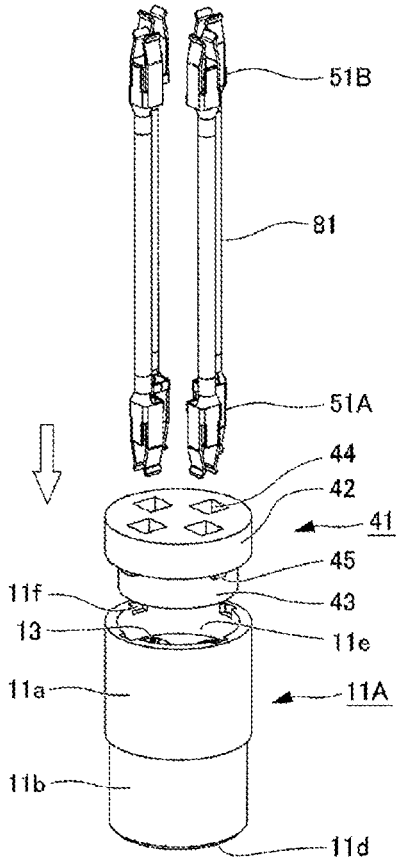
FIG. 8 is a view describing an assembly procedure of the connector according to Embodiment 1, and is a view illustrating a step of inserting a first terminal side of the flexible member into the aligning member.

First, a step S1 of inserting the first terminal 51A side of the flexible member 81 into the aligning member 41 is described while referring to FIG. 8. As illustrated in FIG. 8, the aligning member 41 is positioned above the aligning member storing recess part 11*e* of the first housing 11A such that the terminal storing cavity 13 of the first housing 11A and flexible member insertion cavity 44 of the aligning member 41 are mutually opposing. At this time, the protrusion part 45 for positioning the aligning member 41 and a recessed part 11*f* for positioning the aligning member storing recess part 11*e* of the first housing 11A are naturally also at opposing positions. Next, as illustrated in FIG. 9, the flexible member 81 is inserted into the flexible member insertion cavity 44 from the first terminal 51A as indicated by the white arrow in FIG. 8, in a condition where the protrusion part 45 for positioning and recess part 11*f* for positioning are engaged and the aligning member 41 and first housing 11A are overlaid.

Figure 9:
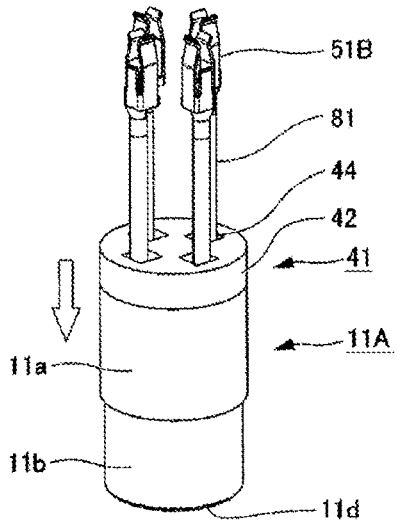
FIG. 9 is a view describing an assembly procedure of the connector according to Embodiment 1, and is a view illustrating a step of engaging the aligning member with the first housing, and inserting the first terminal of the flexible member into the first housing.
Figure 10:
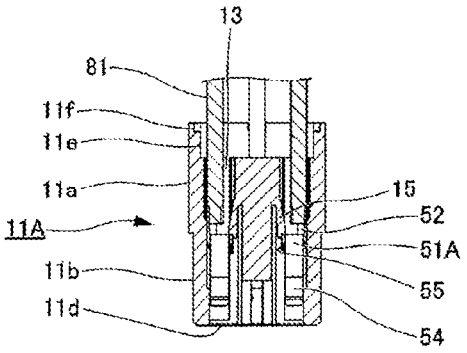
FIG. 10 is a cross-sectional view illustrating a condition in FIG. 9 where the first terminal of the flexible member is inserted into the first housing.

Next, a step S2 of inserting the first terminal 51A into the first housing 11A is described while referring to FIG. 9 and FIG. 10. Following step S1, the first terminal 51A is passed through the inside of the flexible member insertion cavity 44, and the first terminal 51A is inserted into the first housing 11A.

Thereby, as illustrated in FIG. 10, the first terminal 51A is attached to the first housing 11A with the locking piece 55 engaging with the lance 15, and thus will not slip out from the first housing 11A to the second housing 11B side. Note that FIG. 10 illustrates a cross section of a condition where the first terminal 51A is inserted in the first housing 11A in FIG. 9, and omits a depiction of the aligning member 41.

Figure 11:
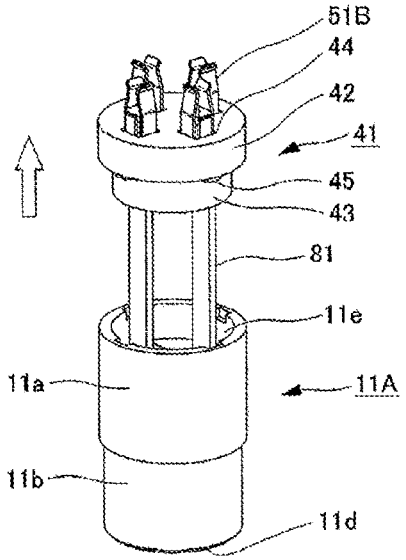
FIG. 11 is a view describing an assembly procedure of the connector according to Embodiment 1, and is a view illustrating a step of separating the aligning member from the first housing, and regulating the second terminal of the flexible member by the aligning member.
Figure 12:
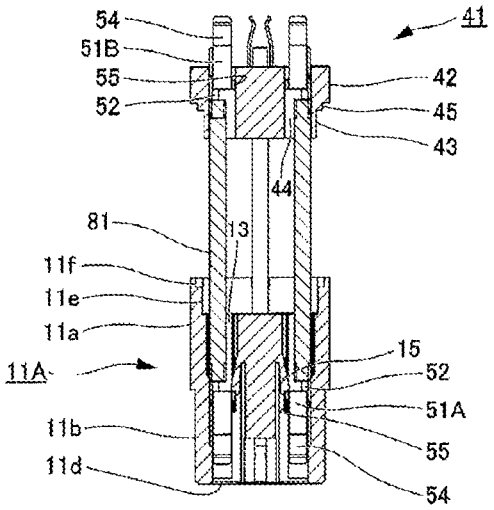
FIG. 12 is a cross-sectional view illustrating a condition of FIG. 11 where the second terminal of the flexible member is restrained by the aligning member.

Next, a step S3 of separating the aligning member 41 from the first housing 11A and aligning the second terminal 51B by the aligning member 41 is described while referring to FIG. 11 and FIG. 12. Following step S2, the aligning member 41 is separated from the first housing 11A, and the aligning member 41 is moved to the second housing 11B side along the flexible member 81 as indicated by the white arrow in FIG. 11. Furthermore, the second terminal 51B is inserted from the base part 52 side into the flexible member insertion cavity 44 of the aligning member 41 from the opening on the protruding part 43 side. The second terminals 51B are aligned by storing the second terminals 51B in the flexible member insertion cavity 44. The terminals 51 contact the inner surface of the flexible member insertion cavity 44 at a position where the locking piece 55 and base part 52 are stored inside the flexible member insertion cavity 44 of the aligning member 41, such that the second terminal 51B and aligning member 41 are held together by a resistance force due to friction. At this time, a tip end side of the contact piece 54 of the second terminal 51B is retained at a position protruding from the aligning member 41.

Thereby, even if the flexible member 81 bends over or faces various directions, the first terminal 51A engages with the lance 15 inside the first housing 11A and will not slip out. Therefore, as illustrated in FIG. 12, the flexible member 81 is tensioned, and thus each of the second terminals 51B can be accurately positioned corresponding to the terminal storing cavity 13 of the second housing 11B in the three directions of X, Y, and Z indicated in FIG. 1.

Figure 13:
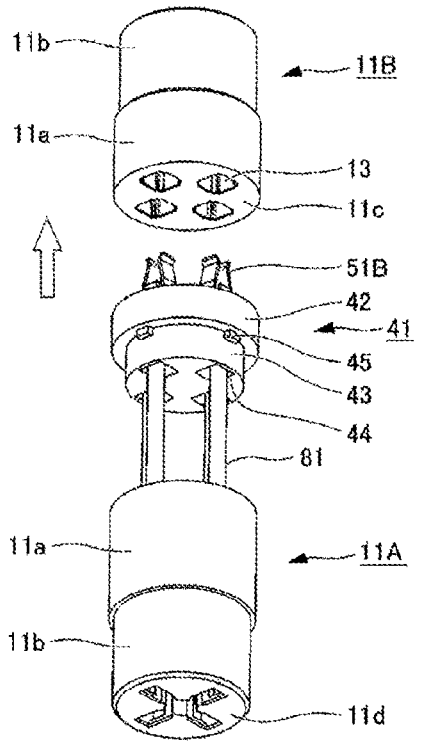
FIG. 13 is a view describing an assembly procedure of the connector according to Embodiment 1, and is a view illustrating a step of inserting the second terminal of the flexible member restrained by the aligning member into the second housing.

Next, a step S4 of inserting the second terminal 51B aligned by the aligning member 41 into the second housing 11B is described while referring to FIG. 13. Following step S3, the contact piece 54 retained and protruding on the aligning member 41 is inserted so as to be stored in the terminal storing cavity 13 opened on the base end surface 11*c* of the second housing 11B, as indicated by the white arrow in FIG. 13. Here, the position and orientation of the second terminal 51B are aligned with the opening of the terminal storing cavity 13 of the second housing 11B by the aligning member 41, eliminating the need to individually align each of the second terminals 51B with the corresponding terminal storing cavity 13 of the second housing 11B.

Figure 14:
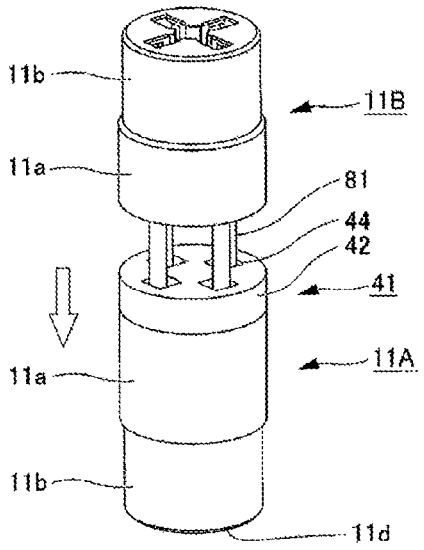
FIG. 14 is a view describing an assembly procedure of the connector according to Embodiment 1, and is a view illustrating a step of separating the aligning member from the second terminal of the flexible member.

Next, a step S5 separating the aligning member 41 from the second terminal 51B is described while referring to FIG. 14. Following step S4, the second terminal 51B is stored in the second housing 11B by passing completely from the base end surface 11*c* to the tip end surface 11*d* of the second housing 11B, and the lance 15 is attached to the second housing 11*b* by engaging with the locking piece 55, thereby completing assembly of the connector 10. The aligning member 41 can freely move with regard to the flexible member 81, and therefore, when the first housing 11A is used as a lower housing and the second housing 11B is used as an upper housing, the aligning member 41 may move to the aligning member storing recess part 11*e* of the first housing 11A as indicated by the arrow in FIG. 14.

As described above, the connector 10 where the terminals 51 positioned on two ends of the flexible member 81, such as an electrical wire or the like, can be accurately and easily inserted in a short amount of time into the housing 11 by one aligning member 41, and the aligning member 41 used therein can be provided, as illustrated in FIG. 15.

The effect of the present disclosure can be achieved if the number of flexible members 81, such as an electrical wire or the like, is two or more, and a greater effect can be achieved when the number thereof, in other words, the number of terminals 51, is greater and the distance between the housings 11 on two ends connected by the flexible member 81, in other words, the length of the flexible member 81, is short.

Next, Embodiment 2 will be described. Note that for portions having the same structure as that of Embodiment 1, descriptions thereof are omitted by applying the same reference symbols. Furthermore, descriptions of the same operations and effects as those of Embodiment 1 will be omitted.

In the aforementioned Embodiment 1, when assembly of the connector 10 is completed, the aligning member 41 is stored in the aligning member storing recess part 11*e* of the first housing 11A as illustrated in FIG. 14 and FIG. 15. In contrast, when assembly of the connector 10 is completed in the present embodiment, the aligning member 41 is attached to the second housing 11B through a first attachment 21A and second attachment 21B. Note that the first attachment 21A and second attachment 21B essentially have the same structure and may be described as an attachment 21 when both are collectively described in the present disclosure. The attachment 21 may be formed from an insulating material such as a synthetic resin or the like, similar to the housing 11.

Figure 16:
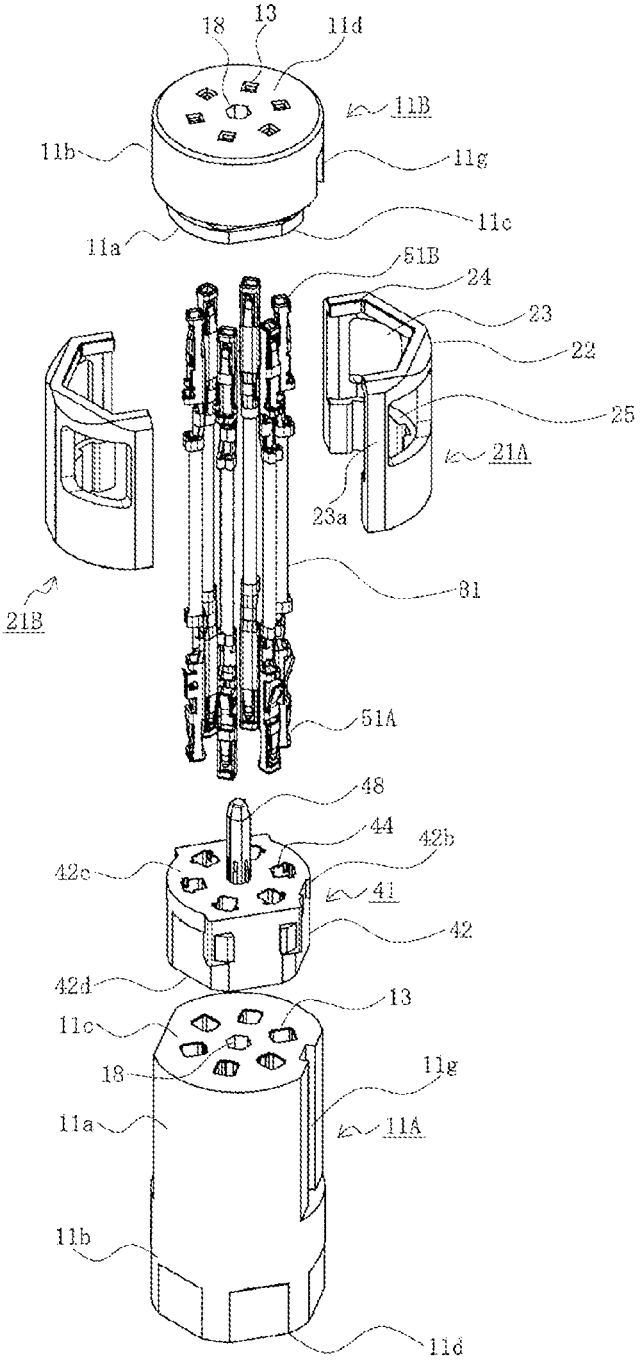
FIG. 16 is a perspective view prior to assembling a connector according to Embodiment 2.
Figure 17:
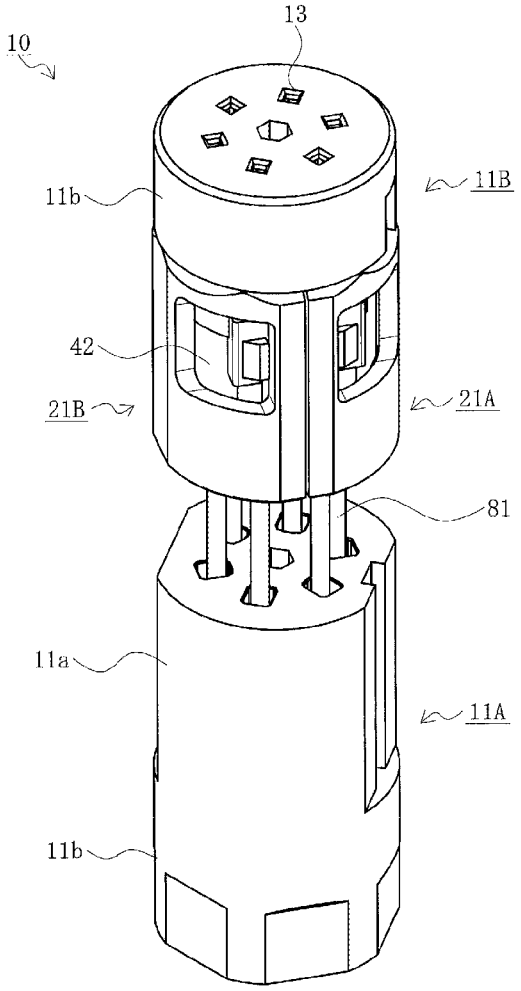
FIG. 17 is a perspective view after assembling the connector according to Embodiment 2.
Figure 18A:
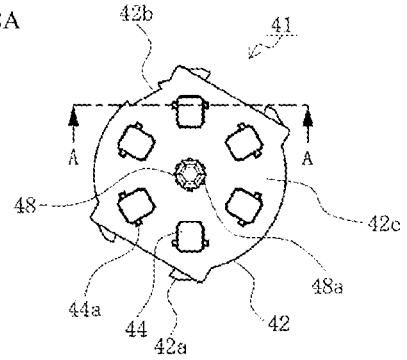
FIGS. 18A-18D are four-sided views of an aligning member according to Embodiment 2, where
Figure 18D:
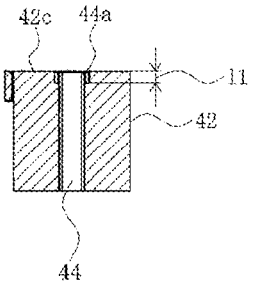
Figure 18B:
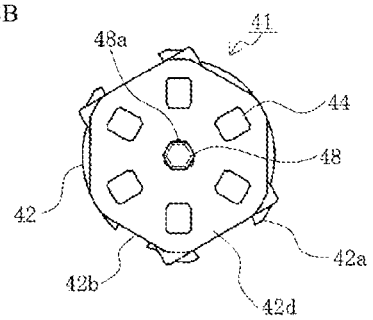
Figure 18C:
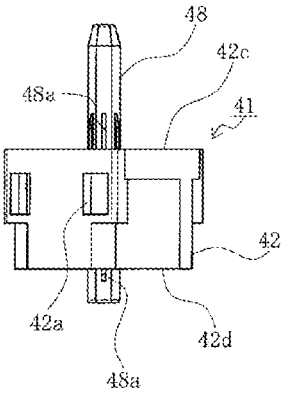
Figure 19A:
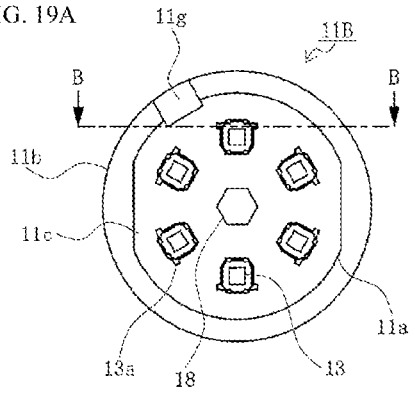
FIGS. 19A-19D are four-sided views of a second housing according to Embodiment 2, where
Figure 19D:
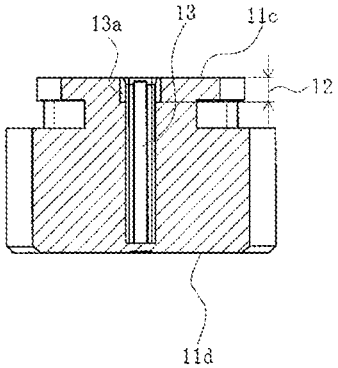
Figure 19B:
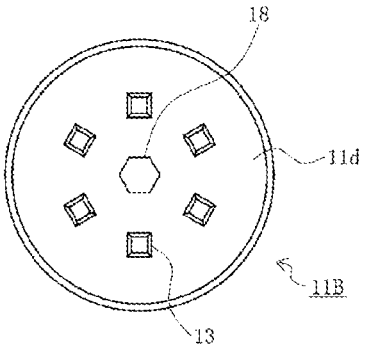
Figure 19C:
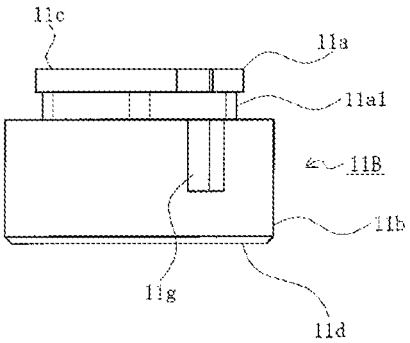

The connector 10 of the present embodiment includes a first attachment 21A and a second attachment 21B as illustrated in FIG. 16, which is an exploded view prior to assembly. Furthermore, as illustrated in FIG. 17, after assembling the connector 10, the aligning member 41 is attached to the second housing 11B through the first attachment 21A and second attachment 21B.

Furthermore, in the examples illustrated in the drawings, there are six flexible members 81. However, the number and arrangement of the flexible members 81 can be appropriately changed.

The aligning member 41 in Embodiment 1 is composed of the protruding part 43 and protrusion part 45 for positioning. However, the aligning member 41 of the present embodiment does not include the protruding part 43 and protrusion part 45 for positioning.

As illustrated in FIGS. 18A-18D, the aligning member 41 of the present embodiment has a rotation stopping pole 48 serving as a polygonal column attached to the main body part 42 with the center of the main body part 42 penetrating in a thickness direction (inserting direction of the flexible member 81). The rotation stopping pole 48 is a hexagonal rod-shaped member in the example illustrated in the drawings, and protrudes in the vertical direction (inserting direction of the flexible member 81) from a second housing side surface 42*c* and first housing side surface 42*d* of the main body part 42.

Furthermore, a plurality of hooking parts 42*a* that protrude outwardly and one groove part 42*b* that extends in the vertical direction (inserting direction of the flexible member 81) are formed on an outer circumferential surface of the main body part 42.

Furthermore, a protruding piece engaging groove 44*a* is formed on an end part of the second housing side surface 42*c* in each flexible member insertion cavity 44. The protruding piece engaging groove 44*a* is a long and narrow recess part with an upper end open in the second housing side surface 42*c* and extending downwardly (direction of the first housing side surface 42*d*) from the second housing side surface 42*c* by only a predetermined length (depth), and is capable of storing an engagement protruding piece 57 described later, which is provided by the second terminal 51B.

The first housing 11A of the Embodiment 1 contains the aligning member storing recess part 11*e* and the recess part 11*f* for positioning. However, the first housing 11A in the present embodiment does not contain the aligning member storing recess part 11*e* and recess part 11*f* for positioning.

Note that one groove part 11*g* extending in the vertical direction (inserting direction of the flexible member 81) is formed on an outer circumferential surface of the base end part 11*a* of the first housing 11A in the present embodiment. Furthermore, a rotation stopping hole 18 open at the center of the base end surface 11*c* is formed on the base end part 11*a*. The rotation stopping hole 18 is a polygonal hole with a hexagonal cross section in the example illustrated in the drawings, and the rotation stopping pole 48 is inserted therein.

The lance 15 is formed on the wall surface of the terminal storing cavity 13 in the second housing 11B in Embodiment 1. However, the lance 15 is not formed on a wall surface of the terminal storing cavity 13 in the second housing 11B of the present embodiment.

As illustrated in FIGS. 19A-19D, a protruding piece engaging groove 13*a* is formed on an end part on the base end surface 11*c* side in each terminal storing cavity 13 in the second housing 11B of the present embodiment. The protruding piece engaging groove 13*a* is a long and narrow recess part with an upper end open on the base end surface 11*c* and extending downwardly (direction of the tip end surface 11*d*) from the base end surface 11*c* by only a predetermined length (depth), and is capable of storing an engagement protruding piece 57 described later, which is provided by the second terminal 51B.

Furthermore, the base end part 11*a* is formed such that an outer diameter thereof is smaller than the tip end part 11*b*, and an attachment engaging groove 11*a*1 that continues in a circumferential direction is formed on an outer circumferential surface of a portion adjacent to the tip end part 11*b*. Furthermore, one groove part 11*g* extending in the vertical direction (inserting direction of the flexible member 81) is formed on an outer circumferential surface of the tip end part 11*b*. Furthermore, a rotation stopping hole 18 open at the center of the base end surface 11*c* and tip end surface 11*d* is formed on the base end part 11*a* and the tip end part 11*b*. The rotation stopping hole 18 is a polygonal hole with a hexagonal cross section in the example illustrated in the drawings, and the rotation stopping pole 48 is inserted therein.

The shape of a portion of the second terminal 51B provided on one end of the flexible member 81 of the present embodiment is different from the second terminal 51B in Embodiment 1.

Figure 20A:
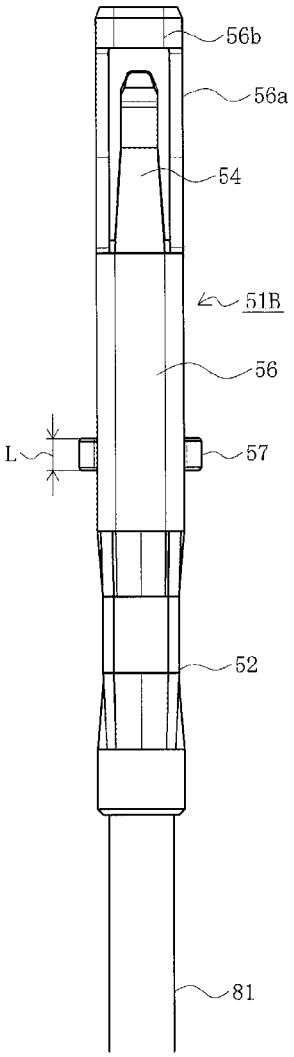
FIGS. 20A-20C are views near a second terminal of a flexible member according to Embodiment 2, where
Figure 20B:
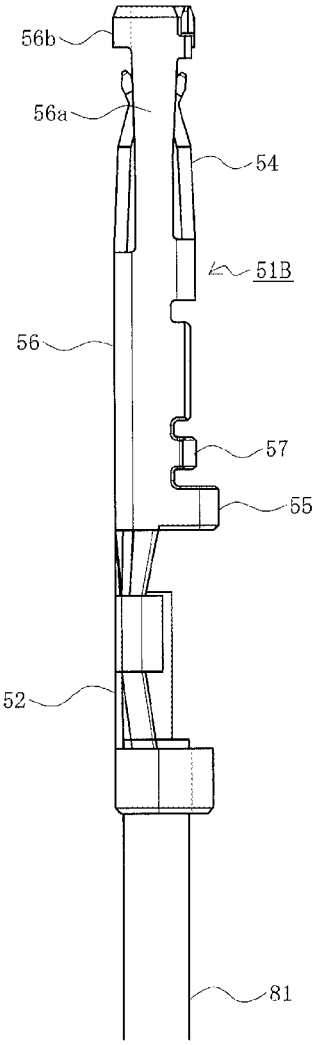
Figure 20C:
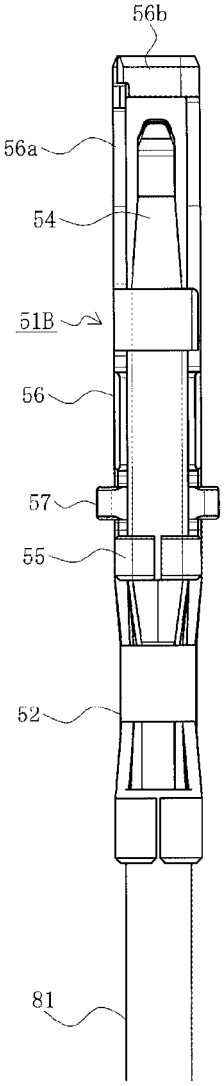

The second terminal 51B in the present embodiment contains the base part 52 connected to an end part of the flexible member 81, and a main body part 56 extending toward a tip end from the base part 52, as illustrated in FIGS. 20A-20C. Furthermore, the main body part 56 contains the locking piece 55 formed to protrude in one direction intersecting the axial direction of the flexible member 81 on the base part 52 side thereof.

Furthermore, the main body part 56 has a pair of side walls 56*a* extending toward a tip end in a mutually opposing condition, a deformation preventing wall 56*b* formed on a tip end of the side wall 56*a*, and a pair of the contact pieces 54 extending toward a tip end in a mutually opposing condition. A tip end side portion of the main body part 56 is formed by the pair of side walls 56*a* and pair of contact pieces 54 to form a quadrilateral shape as viewed from the inserting direction of the flexible member 81. Furthermore, the deformation preventing wall 56*b* is a continuous polygonal cylindrical member that forms a quadrilateral shape as viewed from the inserting direction of the flexible member 81.

Furthermore, the main body part 56 has a pair of the engagement protruding pieces 57 that protrude toward both left and right sides in FIGS. 20A and 20C, so as to intersect in the axial direction of the flexible member 81 as well as a protruding direction of the locking piece 55, in the portion that is adjacent to the locking piece 55. After assembling the connector 10, the engagement protruding piece 57 is stored in the protruding piece engaging groove 44*a* of the aligning member 41 or the protruding piece engaging groove 13*a* of the second housing 11B, and functions as a rotation stop for the second terminal 51B.

Note that the length 11 (refer to FIG. 18D) of the protruding piece engaging groove 44*a* of the aligning member 41 is preferably set to be slightly longer than the length L (refer to FIG. 20A) in the axial direction of the engagement protruding piece 57. Thereby, the entire engagement protruding piece 57 is stored in the protruding piece engaging groove 44*a* and does not protrude out from the second housing side surface 42*c* of the aligning member 41, and therefore does not interfere when attaching the second housing 11B to the aligning member 41. Furthermore, when the length 11 is further increased, for example, to approximately twice the length of length L, all engagement protruding pieces 57 can be made not to protrude out from the second housing side surface 42*c* of the aligning member 41 in the condition illustrated in FIGS. 21 and 22, even if there is a large number of flexible members 81 and a tolerance in the position of the engagement protruding pieces 57.

The assembly procedure of the connector 10 according to the present embodiment will be described.

With the aligning member 41 and first housing 11A overlaying, procedures up to inserting the first terminal 51A of each flexible member 81 through each flexible member insertion cavity 44 of the aligning member 41 into each terminal storing cavity 13 of the first housing 11A are similar to Embodiment 1, and therefore, descriptions thereof will be omitted. Note that in Embodiment 1, the protrusion part 45 for positioning and recess part 11*f* for positioning engage such that the aligning member 41 and first housing 11A are overlaid. However, in the present embodiment, the rotation stopping pole 48 protruding in a downward direction from the first housing side surface 42*d* of the main body part 42 is inserted in the rotation stopping hole 18 open at a center of the base end surface 11*c* of the base end part 11*a*, and the aligning member 41 and first housing 11A are overlaid by bringing the first housing side surface 42*d* and base end surface 11*c* into contact or in close proximity. By inserting the rotation stopping pole 48 into the rotation stopping hole 18, relative rotation of the aligning member 41 and first housing 11A is prevented.

Furthermore, as illustrated in FIGS. 18A-18D, a rib 48*a* protruding outwardly is formed on a side surface of a base portion of the rotation stopping pole 48 protruding in a downward direction from the first housing side surface 42*d* of the aligning member 41. Therefore, when the rotation stopping pole 48 is inserted into the rotation stopping hole 18 of the first housing 11A, the aligning member 41 is secured to the first housing 11A in a condition where the rib 48*a* is lightly pressed into an inner wall surface of the rotation stopping hole 18. Thereby, an operation of inserting the first terminal 51A into the terminal storing cavity 13 of the first housing 11A can be stably performed. Furthermore, the rib 48*a* is only lightly pressed into the inner wall surface of the rotation stopping hole 18, and therefore, the operation of separating the aligning member 41 from the first housing 11A is not hindered.

Figure 21:
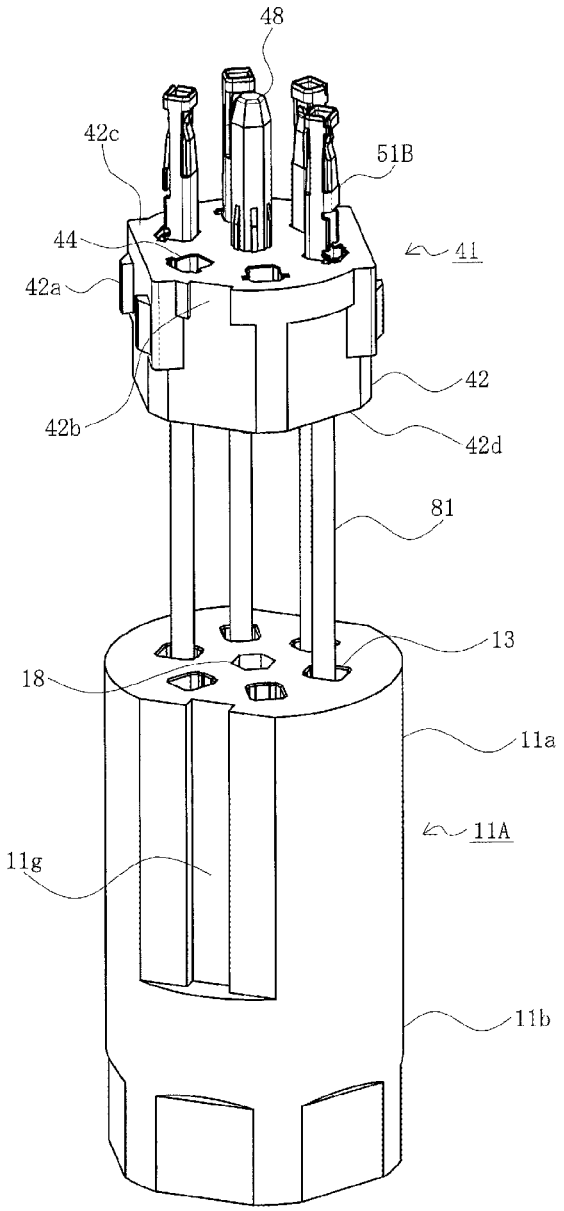
FIG. 21 is a view describing an assembly procedure of the connector according to Embodiment 2, and is a view illustrating a step of separating the aligning member from the first housing, and restraining the second terminal of the flexible member by the aligning member.
Figure 22:
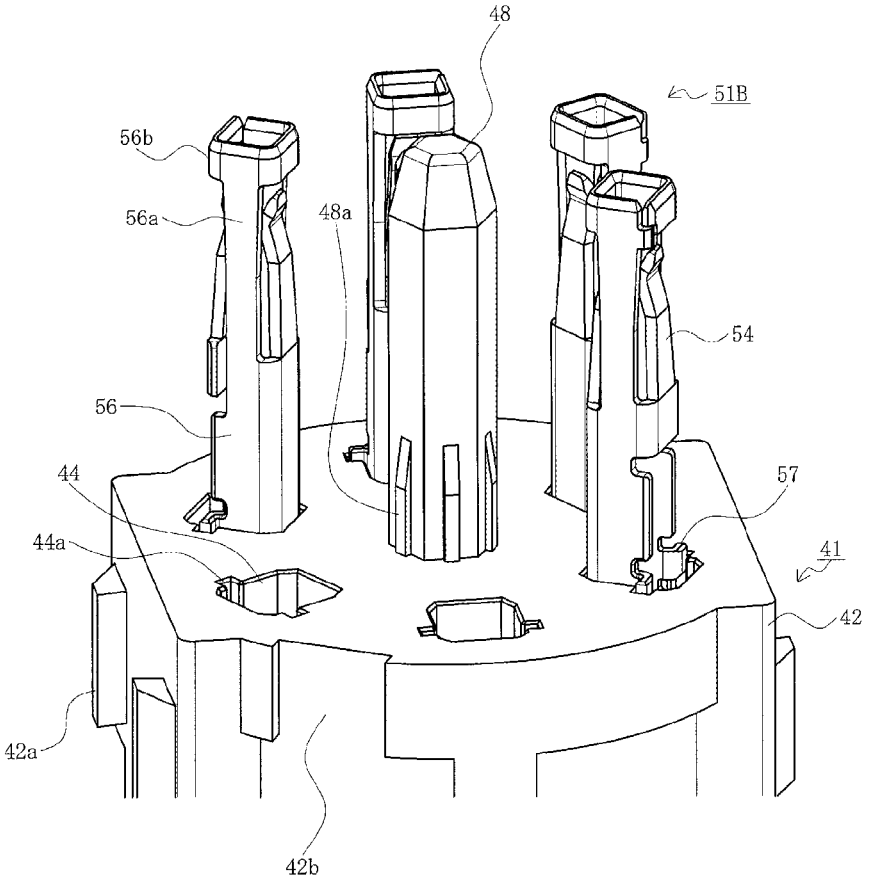
FIG. 22 is an enlarged view of an upper surface side of the aligning member in FIG. 21.

Next, the aligning member 41 is separated from the first housing 11A and moved relative to the second terminal 51B along the flexible member 81, and each second terminal 51B is inserted into each flexible member insertion cavity 44 from the second housing side surface 42*c* side of the main body part 42 and aligned to achieve the condition illustrated in FIGS. 21 and 22. In this condition, each second terminal 51B has the base part 52 and locking piece 55 stored in the flexible member insertion cavity 44 and the pair of engagement protruding pieces 57 stored in the protruding piece engaging groove 44*a* formed on the end part of the second housing side surface 42*c* and engaged with the protruding piece engaging groove 44*a*. Therefore, each of the aligned second terminals 51B cannot move any further toward the first housing side surface 42*d* inside the flexible member insertion cavity 44, and as illustrated in FIGS. 21 and 22, stops with regard to the aligning member 41 in a condition where the contact piece 54, side walls 56*a*, and deformation preventing wall 56*b* protrude upwardly from the second housing side surface 42*c*. Note that in FIGS. 21 and 22, drawings of some of the flexible members 81 are omitted for the sake of explanation.

Figure 23:
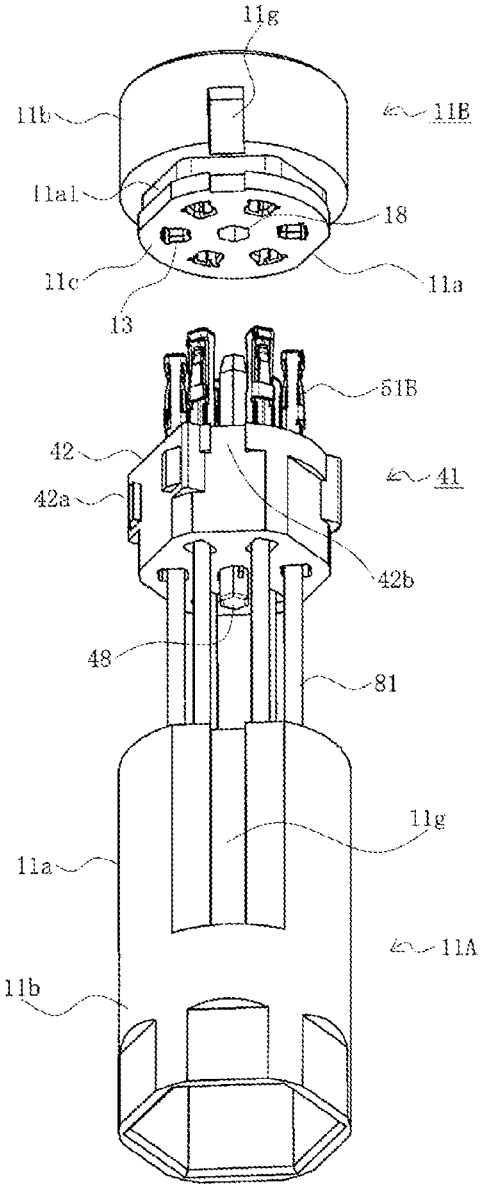
FIG. 23 is a view describing an assembly procedure of the connector according to Embodiment 2, and is a view illustrating a step of inserting the second terminal of the flexible member regulated by the aligning member into the second housing.

Next, as illustrated in FIG. 23, the second housing 11B is aligned with regard to the aligning member 41. Specifically, the base end surface 11*c* opposes the second housing side surface 42*c* in parallel, the rotation stopping hole 18 open at the center of the base end surface 11*c* oppose the rotation stopping pole 48 protruding in an upward direction from the second housing side surface 42*c*, and the terminal storing cavities 13 that are open on the base end surface 11*c* respectively oppose the second terminals 51B.

Next, the second housing 11B is moved relatively toward the aligning member 41, the rotation stopping pole 48 is inserted into the rotation stopping hole 18, the second terminals 51B protruding upwardly from the second housing side surface 42*c* are inserted into the terminal storing cavities 13, the second housing side surface 42*c* and base end surface 11*c* are brought into contact or close proximity, and the aligning member 41 and second housing 11B are overlaid. By inserting the rotation stopping pole 48 into the rotation stopping hole 18, relative rotation of the aligning member 41 and second housing 11B is prevented. Note that the rotation stopping pole 48 may be press-fitted into the rotation stopping hole 18. Thereby, the second terminals 51B are stored inside corresponding terminal storing cavities 13 in the second housing 11B.

Furthermore, as illustrated in FIGS. 18A-18D, a rib 48*a* protruding outwardly is formed on a side surface of a base portion of the rotation stopping pole 48 protruding in an upward direction from the second housing side surface 42*c* of the aligning member 41. Therefore, when the rotation stopping pole 48 is inserted into the rotation stopping hole 18 of the second housing 11B, the aligning member 41 is secured to the second housing 11B in a condition where the rib 48*a* is lightly pressed into an inner wall surface of the rotation stopping hole 18. Thereby, an operation of inserting the second terminal 51B into the terminal storing cavity 13 of the second housing 11B can be stably performed. Furthermore, if the shape of the rib 48A is changed, and the rib 48*a* is strongly pressed into the inner wall surface of the rotation stopping hole 18 to strengthen the securing force of the aligning member 41 to the second housing 11B, the first attachment 21A and second attachment 21B used thereafter can be omitted.

Note that the procedure thus far can be performed by sliding the first housing 11A, aligning member 41, or second housing 11B along a guiding member. For example, a work bench with a straight rail is prepared as a guiding member on a horizontal upper surface. Furthermore, the first housing 11A, aligning member 41, and second housing 11B are respectively turned sideways, and the groove part 11*g* formed on an outer circumferential surface of the base end part 11*a* of the first housing 11A, a groove part 42*b* formed on an outer circumferential surface of the main body part 42 of the aligning member 41, and the groove part 11*g* formed on an outer circumferential surface of the tip end part 11*b* of the second housing 11B are slidably fitted to the rail. In this manner, the first housing 11A, aligning member 41, or second housing 11B can be slid along one rail to be approached or separated from each other.

Figure 24:
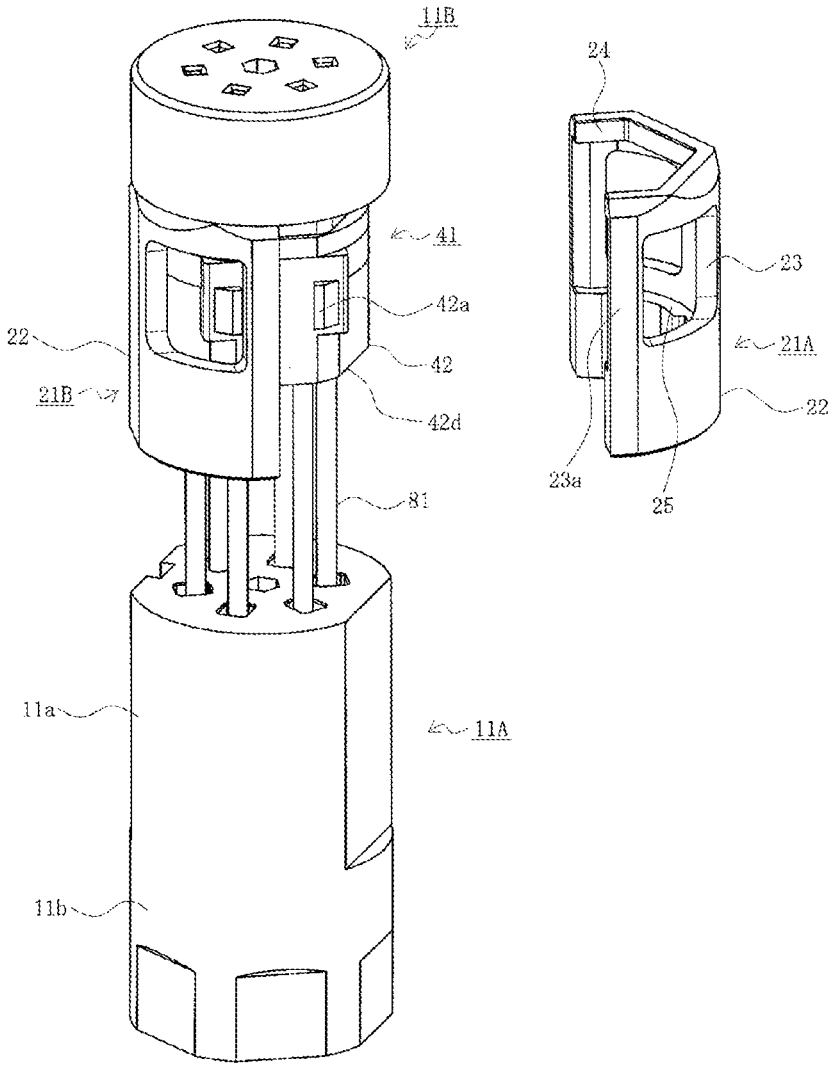
FIG. 24 is a view describing an assembly procedure of the connector according to Embodiment 2, and is a view illustrating a step of attaching the aligning member to the second housing.
Figure 25A:
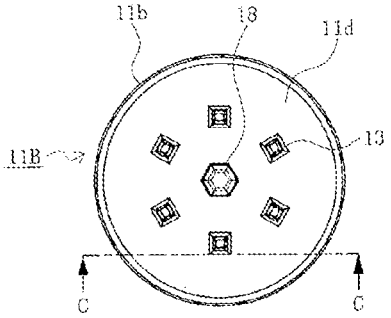
FIGS. 25A and 25B are views after assembling the connector according to Embodiment 2, where
Figure 25B:
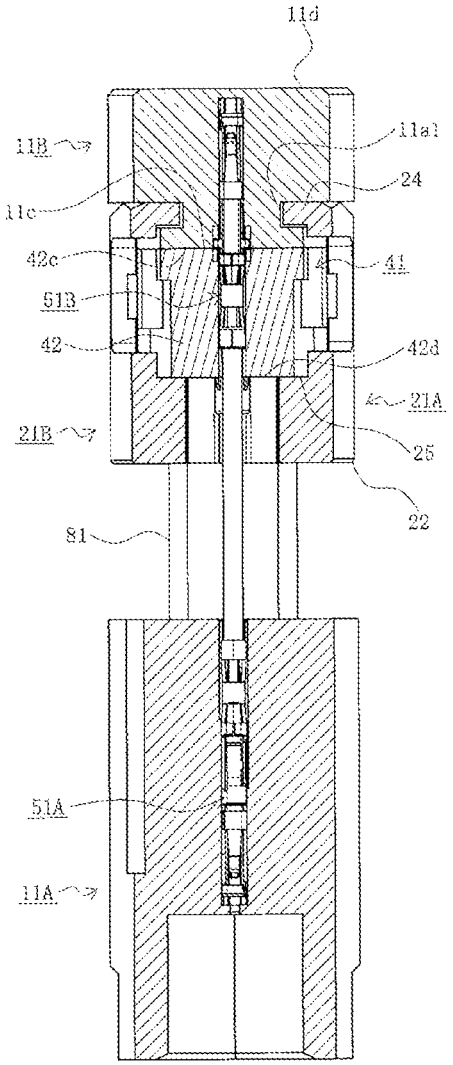
Figure 26:
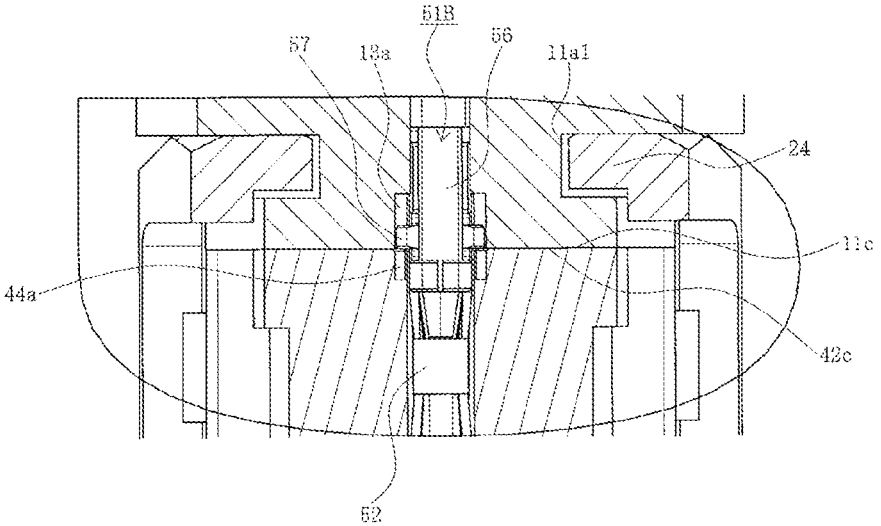
FIG. 26 is an enlarged view of a main part in FIG. 25B.

Next, as illustrated in FIGS. 24 to 26, the first attachment 21A and second attachment 21B are used to attach the aligning member 41 overlaid on the second housing 11B to the second housing 11B. The first attachment 21A and second attachment 21B each have: a main body part 22 having an overall shape such as a semi-cylinder where a cylinder is divided vertically into two parts; a window part 23 formed on the main body part 22; a bottom part 24 protruding inwardly on an upper end (end on second housing 11B side) of the main body part 22; and step part 25 protruding inwardly on a lower side of the window part 23 of the main body part 22. Furthermore, a portion corresponding to a crosspiece demarcating a side end of the window part 23 is a locking piece 23*a*.

The first attachment 21A and second attachment 21B are attached from both left and right sides, such that a circumferential surface of the main body part 42 of the aligning member 41 is covered. As a result, the locking piece 23*a* is locked to the hooking part 42*a* of the main body part 42 of the aligning member 41. The locking piece 23*a* is an elastic member functioning as a spring and exerts a spring force. Therefore, the locking condition with the hooking part 42*a* is not easily released. Furthermore, the bottom part 24 enters and engages in the attachment engaging groove 11*a*1 of the second housing 11B. Furthermore, the step part 25 engages with the first housing side surface 42*d* of the main body part 42 of the aligning member 41. Thus, the bottom part 24 engages with the attachment engaging groove 11*a*1 of the second housing 11B, and the step part 25 engages with the first housing side surface 42*d* of the main body part 42 of the aligning member 41. Therefore, a condition is maintained where the aligning member 41 is attached to the second housing 11B by the first attachment 21A and second attachment 21B. Thereby, the positional relationship between the aligning member 41 and the second housing 11B is stabilized, and therefore a load is prevented from being applied to the flexible member 81.

Note that as illustrated in FIGS. 25A, 25B and 26, the second terminals 51B are in a condition where the base part 52 and locking piece 55 are stored in the flexible member insertion cavity 44 of the aligning member 41, and the contact piece 54, side walls 56*a* and deformation preventing wall 56*b* are stored in the terminal storing cavity 13 of the second housing 11B. However, as described above, the lance 15 is not formed on the wall surface of the terminal storing cavity 13 of the second housing 11B. Therefore, the second terminals 51B can move to some degree in the inserting direction (vertical direction in FIGS. 25A, 25B and 26) of the flexible member 81. For example, in the example in FIG. 26, the engagement protruding piece 57 of the second terminal 51B is positioned inside the protruding piece engaging groove 13*a* in the terminal storing cavity 13, but may be positioned inside the protruding piece engaging groove 44*a* in the flexible member insertion cavity 44. Note that with regard to the inserting direction of the flexible member 81, a length 12 of the protruding piece engaging groove 13*a* in the terminal storing cavity 13 is preferably set to be longer than the length 11 of the protruding piece engaging groove 44*a* in the flexible member insertion cavity 44. Thus, when the length 12 of the protruding piece engaging groove 13*a* is longer than the length L of the engagement protruding piece 57, the second terminal 51B can move in the inserting direction of the flexible member 81. Therefore, even if there is a tolerance in the dimension of the flexible member 81 or the press-fitting position of the first terminal 51A in the terminal storing cavity 13 of the first housing 11A, the tolerance can be absorbed.

Note that if the length 11 of the protruding piece engaging groove 44*a* in the flexible member insertion cavity 44 is sufficiently long, the length of the protruding piece engaging groove 13*a* in the terminal storing cavity 13 can be reduced, and the protruding piece engaging groove 13*a* can be omitted.

As described above, the connector 10 where the terminals 51 positioned on two ends of the flexible member 81, such as an electrical wire or the like, can be accurately and easily inserted in a short amount of time into the housing 11 by one aligning member 41, and the aligning member 41 used therein can be provided.

Note that configurations and operations of other components of the connector 10 of the present embodiment are the same as those of Embodiment 1, and the descriptions thereof will be omitted.

Although preferred embodiments of the present disclosure are described above, the present disclosure is not limited to the aforementioned embodiments, and various modifications and changes are possible within a scope of the gist of the present disclosure described in the scope of the claims.

For example, the first terminal 51A and second terminal 51B are described as receptacle terminals having the same shape in the present embodiment. However, either one of the terminals may be connected to the flexible member 81 as a rod-shaped terminal and protrude from the housing 11 to be directly connected to a wiring board or apparatus without using a mating connector. Furthermore, in the present embodiment, the shape of the opening of the flexible member insertion cavity 44 of the aligning member 41 and the shape of the terminal 51 are described as quadrilateral shapes. However, the opening shape is not particularly limited so long as the terminal 51 does not significantly rotate about the inserting direction and does not shift in position.

The invention claimed is:

1. A connector, comprising:

a first housing;

a first terminal attached to the first housing;

a second housing separate from the first housing;

a second terminal attached to the second housing;

a flexible member where the first terminal and the second terminal are connected at two ends, and connecting the first housing and the second housing; and an aligning member having a flexible member insertion cavity where the flexible member is inserted, and that is movably provided between the first housing and the second housing in a condition where the flexible member is inserted, wherein the aligning member comprises: a main body part positioned on a side of the second housing; and a protruding part that protrudes to a side of the first housing from the main body part.

2. The connector according to claim 1, wherein the flexible member insertion cavity of the aligning member is an opening where the first terminal and the second terminal can be inserted, and the first terminal and the second terminal are arranged to be attachable to the first housing and the second housing.

3. The connector according to claim 1, wherein the aligning member has a protrusion part for positioning that protrudes at a boundary between the main body part and the protruding part; and the protrusion part for positioning engages with a recess part for positioning provided on the first housing.

4. A connector, comprising:

a first housing;

a first terminal attached to the first housing;

a second housing separate from the first housing;

a second terminal attached to the second housing;

a flexible member where the first terminal and the second terminal are connected at two ends, and connecting the first housing and the second housing; and an aligning member having a flexible member insertion cavity where the flexible member is inserted, and that is movably provided between the first housing and the second housing in a condition where the flexible member is inserted, wherein the flexible member insertion cavity of the aligning member is an opening where the first terminal can be inserted, the second terminal is stopped in a condition where a contact piece of the second terminal protrudes, and the first and second terminal are arranged to be attachable to the first housing and second housing.

5. The connector according to claim 4, wherein the aligning member comprises: a main body part; and a polygonal column that protrudes to sides of the first housing and second housing; and the polygonal column is inserted into polygonal holes provided in the first housing and second housing.

6. The connector according to claim 5, wherein the aligning member is attached to the second housing by an attachment.

7. The connector according to claim 4, wherein the second terminal comprises an engagement protruding piece, and the flexible member insertion cavity of the aligning member contains a protruding piece engaging groove formed on a side of the second housing, and can store the engagement protruding piece.

8. The connector according to claim 7, wherein a length of the protruding piece engaging groove is longer than the length in an axial direction of the engagement protruding piece.

9. A method of manufacturing a connector comprises:

a first housing;

a first terminal attached to the first housing;

a second housing separate from the first housing;

a second terminal attached to the second housing;

a flexible member where the first terminal and the second terminal are connected at two ends, and connecting the first housing and the second housing; and an aligning member having a flexible member insertion cavity where the flexible member is inserted, and that is movably arranged between the first housing and the second housing in a condition where the flexible member is inserted;

the method comprising:

a step of preparing a deflection member where the first terminal and second terminal are connected at two ends;

a step of overlaying the first housing and the aligning member;

a step of attaching the first terminal to the first housing by inserting the aligning member;

a step of moving the aligning member in a direction of the second terminal in a condition where the flexible member is inserted in the aligning member;

a step of inserting the second terminal into the aligning member to cause a contact piece on a tip end side thereof to protrude from the aligning member; and a step of storing the contact piece of the second terminal protruding from the aligning member in the second housing, and storing the second terminal in the second housing.

10. The method for manufacturing a connector according to claim 9, further comprising a step of attaching the aligning member to the second housing by an attachment.

* * * * *